US006053796A

United States Patent [19]

Tung

[11] Patent Number: 6,053,796

[45] Date of Patent: Apr. 25, 2000

[54] YO-YO

[75] Inventor: Wen Shuan Tung, Taipei Hsien, Taiwan

[73] Assignee: Lisa Lin, Taipei, Taiwan

[21] Appl. No.: 09/109,931

[22] Filed: Jul. 2, 1998

[51] Int. Cl.[7] ..... A63H 1/30

[52] U.S. Cl. ..... 446/250

[58] Field of Search ..... 446/250

[56] References Cited

U.S. PATENT DOCUMENTS

| | | | |
|---|---|---|---|
| 4,332,102 | 6/1982 | Caffrey | 446/250 |
| 5,254,027 | 10/1993 | McAvoy | 446/250 |
| 5,389,029 | 2/1995 | McAvoy | 446/250 |
| 5,813,897 | 9/1998 | VanDanElzen et al. | 446/250 |

*Primary Examiner*—John A. Ricci
*Attorney, Agent, or Firm*—Bacon & Thomas

[57] ABSTRACT

A yo-yo includes a left yo-yo half cap, a left half yo-yo body, a clutch mechanism, a right yo-yo half body and a string. A shaft fixed on the left yo-yo half cap fits through a shaft sleeve of the clutch mechanism and the left yo-yo half body and firmly in the right yo-yo half body for an inner end of a string to tie and wind around on to let the yo-yo move up and down with the string. The clutch mechanism has two compression springs respectively located at two sides of the shaft sleeve and fitting in a space in the left yo-yo half cap and two weighted balls respectively located between the shaft sleeve and the springs. The clutch mechanism functions to force the balls to engage and disengage the shaft sleeve or, letting the yo-yo rotate and wind/unwind itself on the string or rotate idle on the end of the string.

1 Claim, 4 Drawing Sheets

YO-YO

BACKGROUND OF THE INVENTION

This invention relates to a yo-yo, particularly to one having a few components and low percentage of wear and tear.

Conventional yo-yoes may be classified into two kinds according to structure. One kind has a simple structure, and the other has a clutch mechanism.

The first simple kind of yo-yo includes a male half and a female half, and a shaft fixed on the male half for a string to be tied thereon. In playing, the string tied on the male shaft has its free end attached with a ring for a finger of a player to fit in. Then the player pinches a yo-yo between the thumb and the middle finger, and then throws the yo-yo, letting the yo-yo rotate swiftly and move up and down by means of the string wound around the male shaft repeatedly, giving amusement to the player. In order to let the yo-yo continue to move up and down, the player has to pull up the yo-yo quickly the moment when the male half with female half comes to the end of the string, as the shaft is always stationary. Then the male half and the female half together may move up to the hand of the player again. Otherwise, the male half and the female half may not move up but stop, with the yo-yo interrupted in playing and amusement cooled off. Although this kind of yo-yo has an advantage of a simple structure with a few components, it is rather hard to handle, gradually going out of fashion.

The second kind of yo-yo having a clutch mechanism is disclosed in a U.S. Pat. No. 4,332,102. Its structure and operation are as follows.

1. It includes two yo-yo halves 10, 12, a central shaft 14, a bearing pulley 44, two clutch members 16, 18, two compressing springs 22, 24, two weighted balls 30, 32, and a central hub 20 as main components combined together. The central shaft 14 passes through a shaft hole around a recession 42 of the yo-yo half 12, a shaft hole (not numbered) of the bearing pulley 44, an opening 50 of the yo-yo half 10, and the shaft hole (not numbered) of the central hub 20, and an exploded perspective view is shown in FIG. 1.

2. The clutch members 16, 18 respectively have a curved recess (not numbered) to correspond to each other for an end of the compression spring to rest on for pinching a friction surface 46 of the bearing pulley 44. The clutch members 16, 18 further respectively have a pin 26, 28 located in a diagonal direction and a weighted ball 30, 32 positioned in a diagonal direction. Then the yo-yo half 10 has two opposite pin holes 52, 54 for the pins 26, 28 of the clutch members 16, 18 to fit therein so that the clutch members 16, 18 may bias to alter their position by means of the pin holes 52, 54.

3. The central shaft 14 is a little smaller than the shaft hole of the bearing pulley 44, and the movement of the bearing pulley 44 is controlled by the two clutch members 16, 18. The bearing pulley 44 further has an annular groove for tying the string 45 as shown in FIG. 4.

4. As for the operation of the yo-yo, when the yo-yo is thrown to swiftly rotate, the clutch members 16, 18 produce centrifugal force to compress the compressing springs 22, 24 by means of the weight of the balls 30, 32, permitting the bearing pulley 44 free not pinched to rotate idle. On the contrary, when the centrifugal force gradually diminishes to less than the elasticity of the compressing springs 22, 24, the springs 22, 24 recover to push the clutch members 16, 18, which may pinch the friction surface 46 of the bearing pulley 44, forcing the yo-yo rotates upward to go back to the hand of the player. So this kind of yo-yo is easier to handle than the first simple kind described above. In addition, when the yo-yo rotates idle, a special trick like idle rotation can be effected, increasing amusing feeling.

Though the second kind of yo-yo of a clutch structure has an advantage of easy handling, it has rather a little too many components to make its structure complicated and high percentage of friction, causing the curved surface of the clutch members 16, 18 contact irregularly with the friction surface 46 of the bearing pulley 44 in friction, forming a disadvantage of high wear and tear.

SUMMARY OF THE INVENTION

This invention has been devised to offer a kind of yo-yo having a simple structure with a few components, little friction, low cost and long service life.

BRIEF DESCRIPTION OF THE DRAWINGS

This invention will be better understood by referring to the accompanying drawings, wherein.

DETAILED DESCRIPTION OF THE PREFERRED EMBODIMENT

Figure 1:
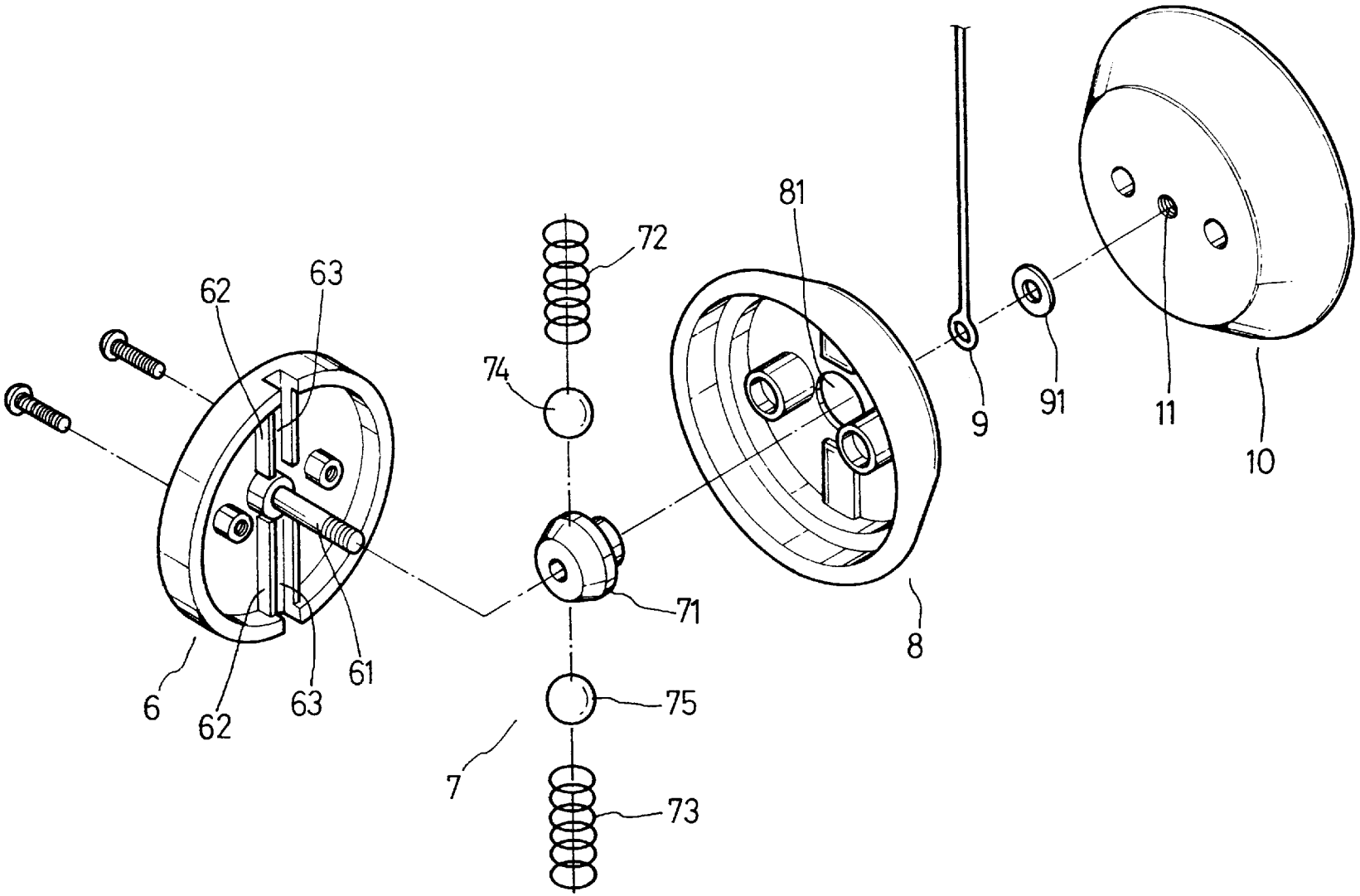
FIG. 1 is an exploded perspective view of a yo-yo in the present invention.

A preferred embodiment of a yo-yo in the present invention, as shown in FIG. 1, includes a left yo-yo half cap 6, a clutch mechanism 7, a left yo-yo half body 8, a string 9, a right yo-yo half body 10 as main components.

The left yo-yo half cap 6 has a shaft 61 with a threaded portion fixed at the center axially, two separating parallel walls 62 are provided diametrically and define a space 63 between them.

The clutch mechanism 7 consists of a shaft sleeve 71 to fit around the shaft 61 of the left yo-yo half cap 6, a pair of compression springs 72, 73 respectively located at two sides of the shaft sleeve 71 and fitting in the space 63 of the left yo-yo half cap 6, and a pair of weighted balls 74, 75 located respectively between the shaft sleeve 71 and the compression springs 72, 73 for elastically pushing the balls 74, 75 to contact the outer surface of the shaft sleeve 71.

The left yo-yo half body 8 has a center hole 81 for the shaft 61 of the left yo-yo half cap 6 to pass through.

Figure 3:
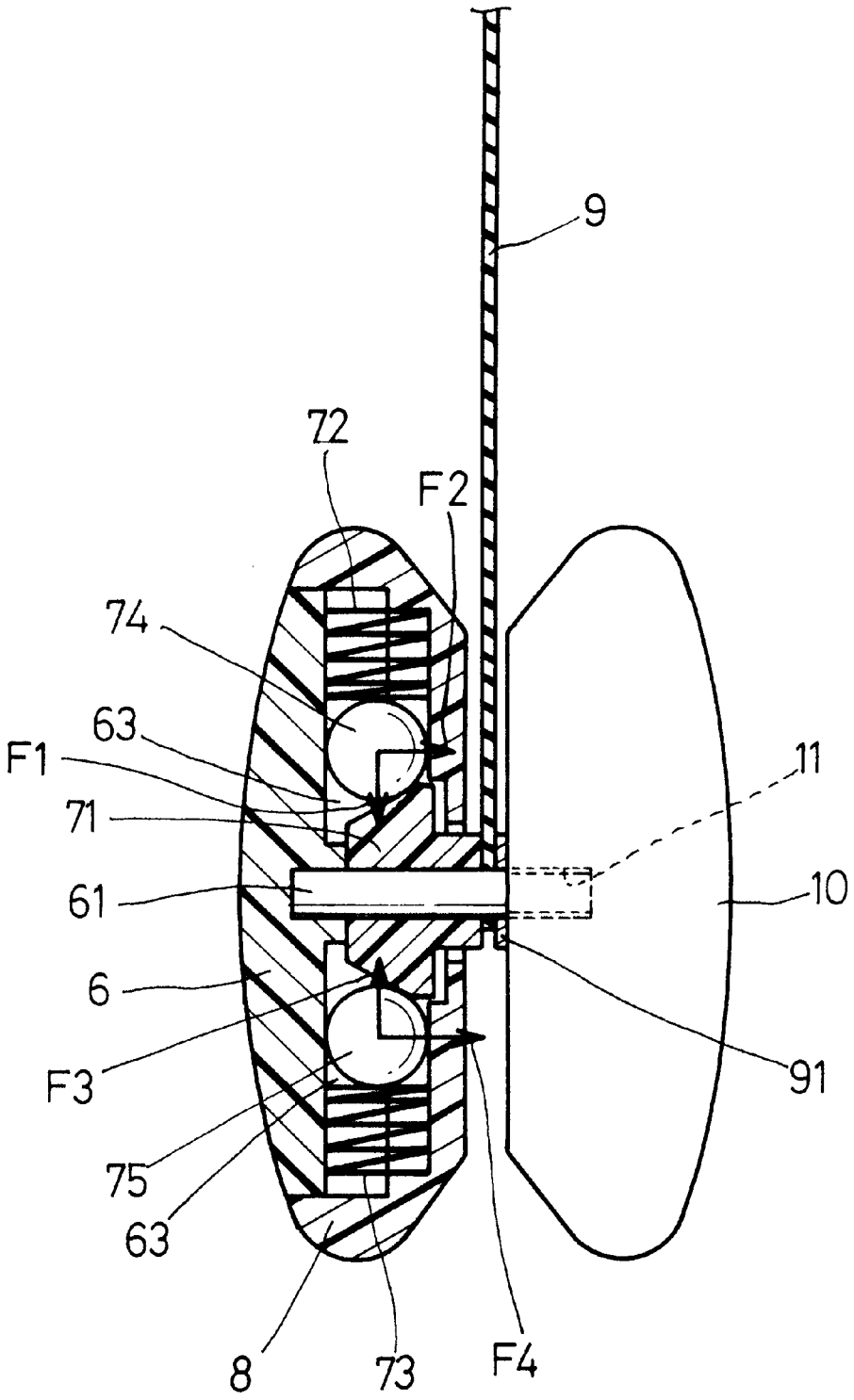
FIG. 3 is a cross-sectional view of the yo-yo in the present invention.

The string 9 has its inner end tied on the shaft 61, with one side contacting the shaft sleeve 71 of the clutch mechanism 7 as shown in FIG. 3, and with the other side pressed by a ring gasket 91 fitting around the shaft 61 against the right yo-yo half body 10.

The right yo-yo half body 10 has a shaft hole 11 in an inner side for a right side end of the shaft 61 to fit firmly therein.

Figure 2:
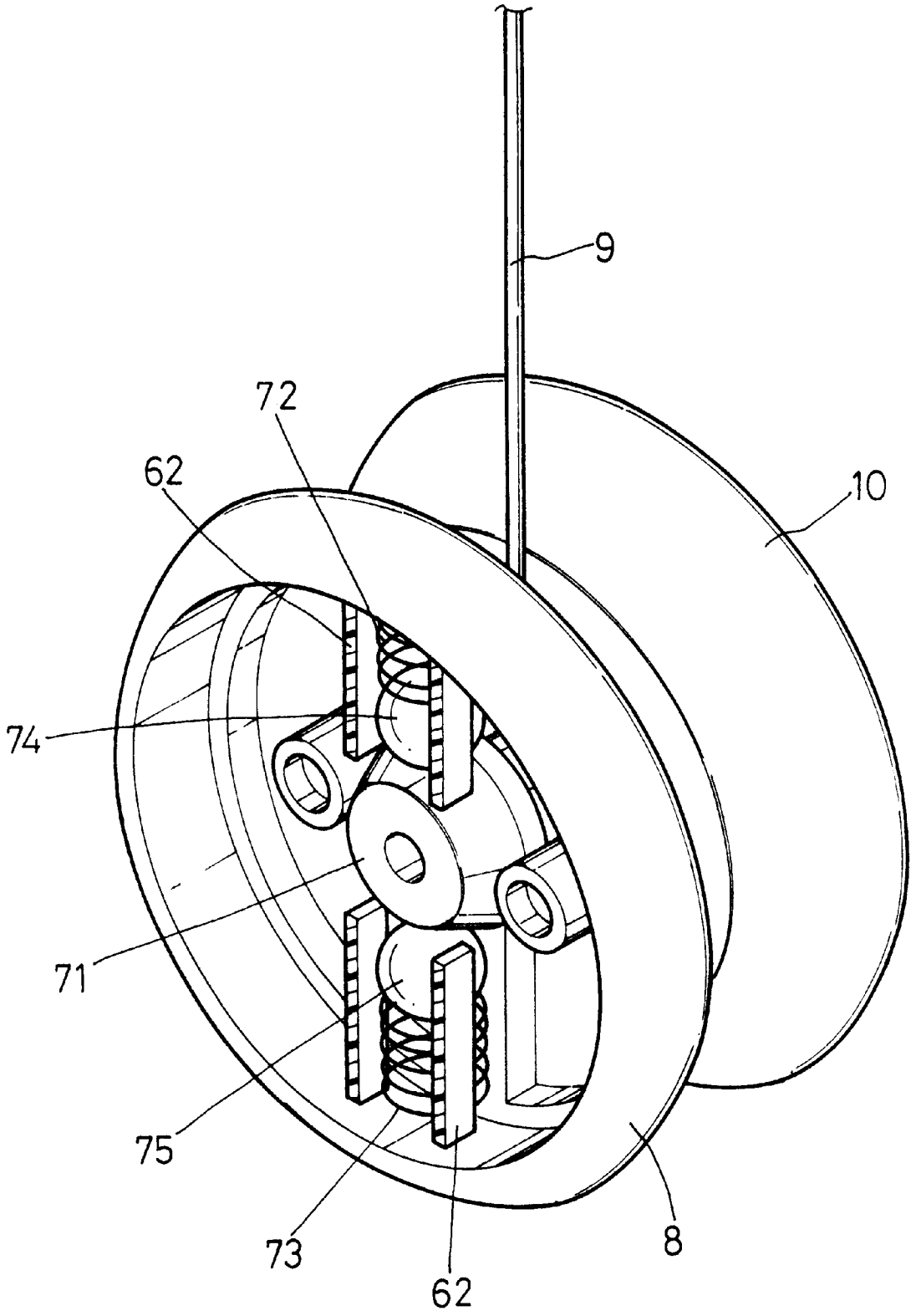
FIG. 2 is a perspective view of the yo-yo with a left half cap removed in the present invention.

The structural view of the yo-yo in the invention after assembled together is seen in FIGS. 2 and 3. When the yo-yo is in a stationary condition, the compressing springs 72, 73 of the clutch mechanism 6 always rest on the left yo-yo half body 8, and also contact the weighted balls 74, 75 at the same time. Then the balls 74, 75 always contact the outer surface of the shaft sleeve 71 with the springs 72, 73 elastically pushing them. In this position, the balls 74, 75 produce forces F1, F2, F3, F4 to push the shaft sleeve 71 at the same time, but the forces F1 and F3 are directed in opposite directions to counteract each other so that only the forces F2 and F4 may function to push the shaft sleeve 71 to compress the string 9, which is then pinched between the shaft sleeve 71 and the ring gasket 91. Thus the balls 74, 75, the shaft sleeve 71 and the shaft 61 may be rotated at the same time.

Figure 4:
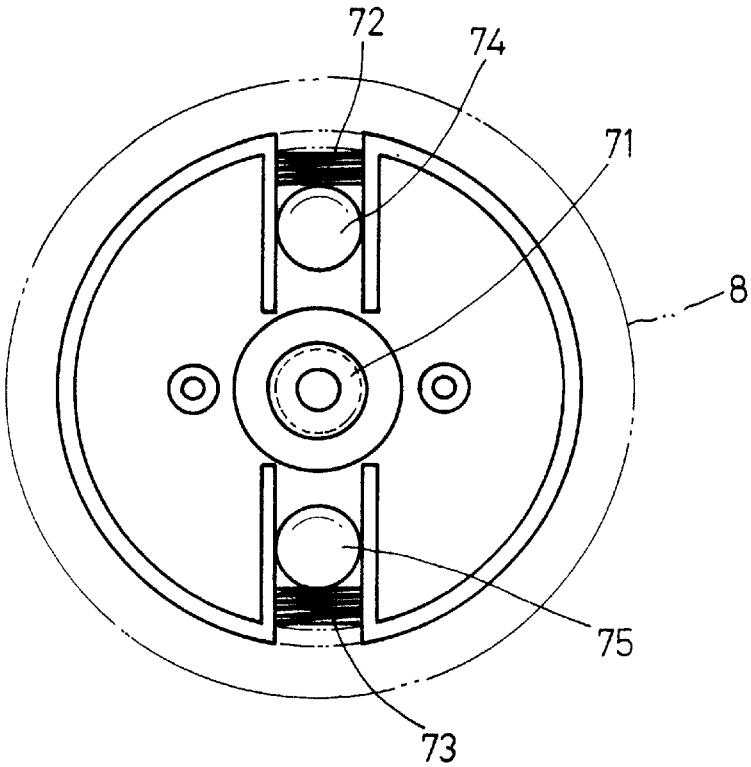
FIG. 4 is a view of a clutch mechanism of the yo-yo in the present invention, showing two weighted balls forced to press two compression springs and separated from a shaft sleeve when the yo-yo is in a swift rotation; and, FIG. 5 is a view of the clutch mechanism of the yo-yo in the present invention, showing the two weighted balls elastically pushed to contact the shaft sleeve by the two compression springs when the yo-yo is in a slow rotation.
Figure 5:
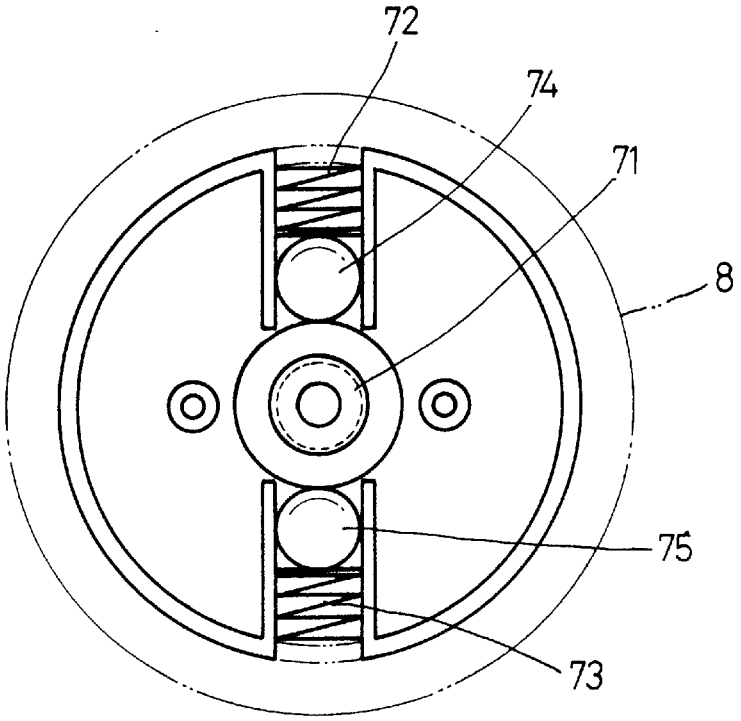

When the yo-yo is thrown by a player, the string 9 begins to be rotated around the shaft, with the weighted balls 74, 75 of the clutch mechanism 7 comprising the compression springs 72, 73 by means of centrifugal force. If the centrifugal force becomes large enough to cause the balls 74, 75 to move outward and compress the compression springs 72, 73 outward as shown in FIG. 4, the balls 74, 75 do not contact the shaft sleeve 71, with the forces F2, F4 of the shaft sleeve pushing on the string 9 eliminated so that the string 9 is free to wind around the shaft 61, which may rotate idle. It does not matter whether the shaft sleeve 71 rotates idle around the shaft 61 or not. Consequently, the string 9 winds around the shaft 61 of itself, but this does not last very long. Once the centrifugal force becomes less than the force of the compression springs 72, 73 pressing the weighted balls 74, 75, the balls 72, 73 will swiftly contact the outer surface of the shaft sleeve 71 so that the string 9 may be pinched by the shaft sleeve 71 as shown in FIGS. 3 and 5. Then the two sides of the string 9 are respectively pinched by the shaft sleeve 71 and the ring gasket 91, Permitting the yo-yo to move up and down with string 9 again.

The clutch mechanism of the present invention is different from that of the known U.S. Patent described above, with the string 9 being the object, not the shaft sleeve 71. The yo-yo of the present invention also has rotation of itself and idle rotation as the known U. S. Patent, having the characteristic of easy handling and possible to make special tricks as idle rotation, in spite of the simple structure with less components than the aforesaid one has. Especially, the curved surface of the weighted balls 74, 75 can evenly contact the curved outer surface of the shaft sleeve 71, obtaining a low wearing effect.

While the preferred embodiment of the invention has been described above, it will be recognized and understood that various modifications may be made therein and the appended claims are intended to cover all such modifications which may fall within the spirit and scope of the invention.

I claim:

1. A yo-yo comprising:

a) a half cap having an inner side, a shaft extending axially from a center of the inner side, and a pair of parallel walls extending diametrically along the inner side and defining a diametric space therebetween;

b) a first half body having a central hole, the shaft extending through the central hole;

c) a second half body having a central shaft hole, the shaft having a terminal end secured within the shaft hole;

d) a string having an outer end for attachment to the finger of a user and an inner end secured to the shaft, a ring gasket on the shaft positioned between the inner end of the string and the second half body;

e) a clutch mechanism including a sleeve slidably mounted on the shaft, a pair of weighted balls and a pair of compression springs disposed within the diametric space, the springs biasing the balls inwardly against opposite sides of the sleeve for axially urging the sleeve against the string and compressing same between the sleeve and the gasket; and f) whereby when the string is wound on the shaft and the yo-yo is thrown by a user, centrifugal force from rotation of the yo-yo causes the balls to disengage from the sleeve and move radially outwardly against the bias of the springs, thereby releasing the sleeve from its compression against the string and permitting the yo-yo to rotate in an idle at the end of the string, and whereupon when the speed of rotation is reduced, a corresponding reduction in the centrifugal force causes the springs to again bias the balls into engagement with the sleeve and urge same axially to compress the string between the sleeve and gasket, thereby permitting the string to be wound around the shaft.

* * * * *